US005387965A

United States Patent [19]

Hasegawa et al.

[11] Patent Number: 5,387,965

[45] Date of Patent: Feb. 7, 1995

[54] TONER CONCENTRATION CONTROL METHOD

[75] Inventors: Shin Hasegawa, Kawasaki; Yasushi Koichi, Yamato; Shinji Kato, Kawasaki, all of Japan

[73] Assignee: Ricoh Company, Ltd., Tokyo, Japan

[21] Appl. No.: 987,816

[22] Filed: Dec. 9, 1992

[30] Foreign Application Priority Data

Dec. 9, 1991 [JP] Japan ..... 3-350007

[51] Int. Cl.[6] ..... G03G 21/00

[52] U.S. Cl. ..... 355/246; 355/208

[58] Field of Search ..... 355/246, 208, 214

[56] References Cited

U.S. PATENT DOCUMENTS

| | | | |
|---|---|---|---|
| 4,277,549 | 7/1981 | Tatsumi et al. | 430/30 |
| 4,370,053 | 1/1983 | Hirayama et al. | 355/246 X |
| 4,468,112 | 8/1984 | Suzuki et al. | 355/246 |
| 4,607,933 | 8/1986 | Haneda et al. | 355/246 |
| 5,038,175 | 8/1991 | Sohmiya et al. | 355/246 |
| 5,049,939 | 9/1991 | Koichi | 355/246 |
| 5,081,491 | 1/1992 | Lux et al. | 355/246 X |
| 5,162,849 | 11/1992 | Yoshino et al. | 355/246 X |

FOREIGN PATENT DOCUMENTS

| | | |
|---|---|---|
| 3-35264 | 2/1991 | Japan . |
| 3-119377 | 5/1991 | Japan . |

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A toner density control method senses the concentration of a toner image for control formed on a photoconductive element by an optical sensor and, based on the output of the sensor, corrects a target target toner concentration for toner supplement control to be effected in response to an output of a toner concentration sensor mounted on a developing device. When the output Vs of the optical sensor is determined to be greater than a reference value $Vs_0$ (short toner deposition), the reference value $Vt_0$ is corrected to smaller one. When Vs determined to be smaller than $Vs_0$ (excessive toner deposition), $Vt_0$ is corrected to greater one. In each of such cases, a predetermined amount $n \cdot \Delta VT$ is subtracted from or added to the output Vt of the toner concentration sensor of that instant.

16 Claims, 6 Drawing Sheets

MAIN SW ON
COPY START
1
CN ≧ 10 ?
2
N
Y
Vs SENSE
3
Vt SENSE
4
Vso < Vs ?
5
N
Y
CALCULATE COEFFICIENT n OF ΔVt FROM |Vso-Vs|
7
Vto ← Vto - n ΔVT
C8
CN1=0 ?
A9
N
Y
1
CN2=0 ?
A10
N
Y
2
Vso > Vs ?
6
N
Y
CALCULATE COEFFICIENT n OF ΔVt FROM |Vso-Vs|
9
Vto ← Vto + n ΔVT
C10

TONER CONCENTRATION CONTROL METHOD

BACKGROUND OF THE INVENTION

The present invention relates to a toner concentration control method for a developing device incorporated in a copier, printer, facsimile transceiver or similar image forming apparatus. More particularly, the present invention is concerned with a toner concentration control method for correcting, based on the output of an optical sensor representative of the density of a toner image for control formed on an image carrier, a target toner concentration for toner supplement control to be effected in response to the output of a toner concentration sensor which is mounted on the developing device.

A toner concentration control method of the kind described is disclosed in, for example, Japanese patent Laid-Open Publication Nos. 136667/1982 and 148679/1991. Generally, even when a toner is supplemented in response to the output of a toner concentration sensor to maintain a target toner concentration in the developing device, it is impossible to maintain the density of a toner image at desired one due to the aging of a photoconductive element or similar image carrier, developer, etc. The toner concentration control method, therefore, senses the density of image for control formed on the image carrier and corrects the target toner concentration such that the desired image density is set up. It has been customary to correct the target toner concentration once a day, i.e., when a power source is turned on, when an image forming operation is resumed after a certain period of time of suspension, or every time a predetermined number of copies are produced or an image forming operation is repeated over a predetermined period of time.

However, the conventional method simply increases or decreases the instantaneous target concentration by a predetermined amount in response to the sensed density of the toner image for control. This brings about a problem that the response to the changes in the characteristic of the image carrier and that of the developer due to aging is slow, making the image density unstable. Specifically, changes in developing characteristic which is susceptible to the aging of image carrier and developer depends on the environment in which an apparatus is operated. Therefore, the change in developing characteristic during the interval between consecutive corrections of target toner concentration differs from one apparatus to another. Assume that the density of the toner image for control is thinner than a target density, requiring the target toner concentration to be corrected to thicker one. Then, when the target toner concentration of that instant is simply increased by a predetermined amount, it may occur that, depending on the difference between the target concentration and the actual concentration in the developing device, toner supplement control using the corrected target concentration and effected in response to the output of the toner concentration sensor does not immediately determine that a supplement is necessary. In such a case, image formation will be executed with the toner concentration remaining low. Conversely, assume that the density of the toner image for control is thicker than the target density and requires the target concentration to be corrected to thinner one. Then, when the target concentration is simply reduced by the predetermined amount, it may occur that, depending on the above-mentioned difference, toner supply control using the corrected target concentration does not immediately determine that a supplement is not necessary, maintaining the toner concentration high.

SUMMARY OF THE INVENTION

It is, therefore, an object of the present invention to provide a toner concentration control method capable of correcting, based on sensed density of a toner image for control formed on an image carrier, a target toner concentration for toner supplement control to be executed in response to the output of a toner concentration sensor mounted on a developing device.

In accordance with the present invention, a toner concentration control method comprises the steps of sensing a density of a toner image for control formed on an image carrier by an optical sensor, sensing a toner concentration of a developer stored in a developing device by a toner concentration sensor mounted on the developing device, and correcting a target toner concentration for toner supplement control on the basis of an output of the toner concentration sensor and an output of the optical sensor.

Also, in accordance with the present invention, in a toner concentration control method comprising the steps of sensing a density of a toner image for control formed on an image carrier by an optical sensor, comparing an output of the optical sensor with a reference value corresponding to a desired image density, and correcting, based on the result of comparison, a target toner concentration for toner supplement control to be executed in response to an output of a toner concentration sensor which is mounted on a developing device; when the output of the optical sensor and the reference value differ from each other by more than a predetermined amount, whether or not a toner should be supplemented during the course of subsequent predetermined number of copying cycles is determined on the basis of the result of comparison of the output of the optical sensor and the reference value.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
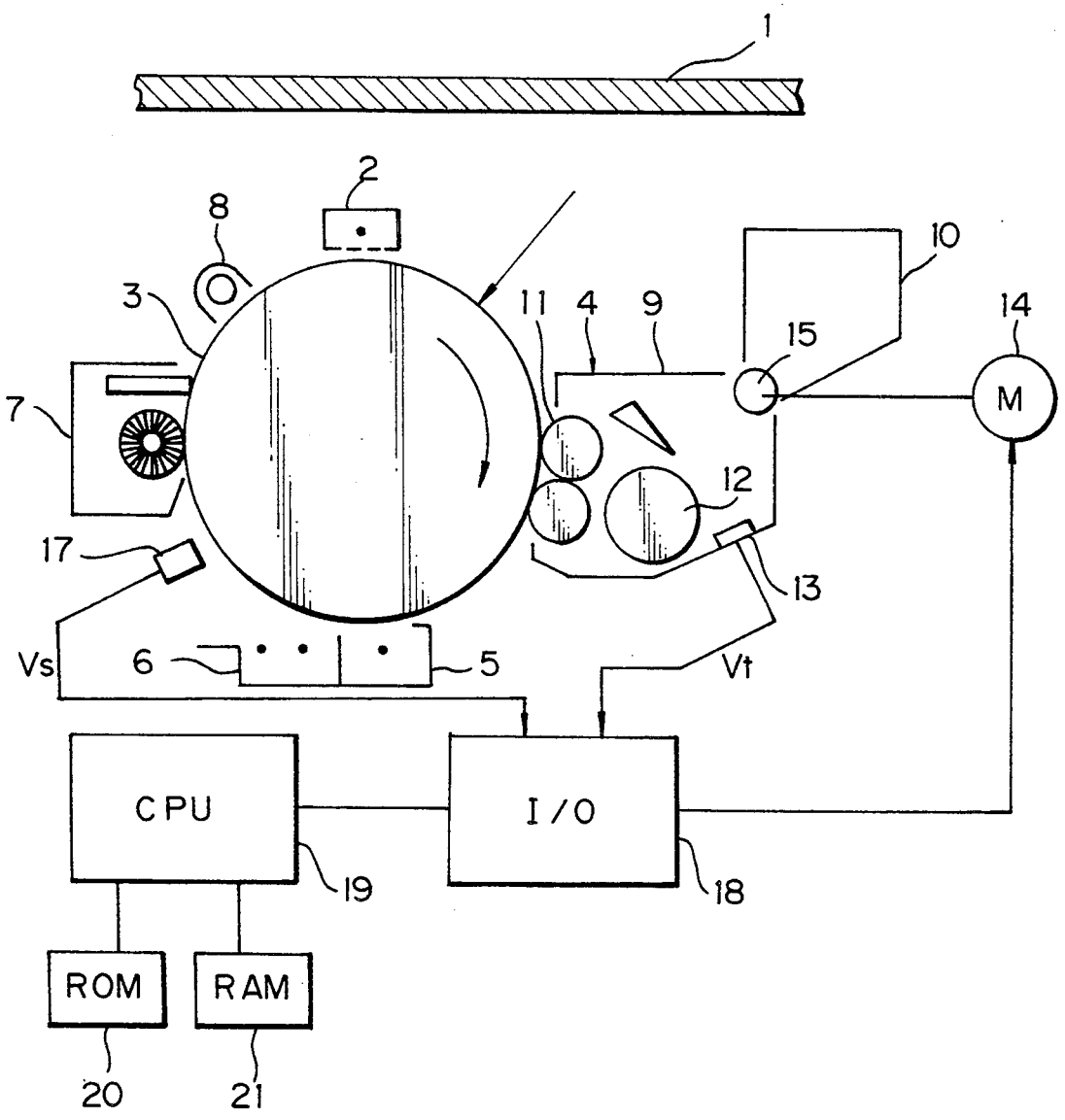
FIG. 1 is a section showing an image forming apparatus with which a toner concentration control method embodying the present invention is practiced.

Referring to FIG. 1 of the drawings, an image forming apparatus implemented as a photographic copier is shown with which a preferred embodiment of the present invention is practiced. As shown, the copier has a glass platen 1 on which a document, not shown, is laid. Optics, not shown, scans the document with illuminating means thereof while moving in a direction parallel to the document. The resulting imagewise reflection from the document is projected onto a photoconductive element, or image carrier, 3 whose surface has been uniformly charged by a main charger 2. The photoconductive element 3 is constituted by a drum by way of example. As a result, a latent image representative of the document image is electrostatically formed on the drum 3. A developing device 4 is located at the right-hand side of the drum 3 and develops the latent image by a toner to produce a toner image. A transfer charger 5 transfers the toner image from the drum 3 to a paper or similar recording medium, not shown, fed from a sheet feed section, not shown. The paper with the toner image is separated from the drum 3 by a separation charger 6 and then driven out of the copier as a copy by way of a fixing unit, not shown. A cleaning unit 7 is disposed at the left-hand side of the drum 3 and removes the toner remaining on the drum 3 after the image transfer. Subsequently, a discharge lamp 8 dissipates the charge also remaining on the drum 3 after the image transfer. Then, the drum 3 is again uniformly charged by the main charger 2 to prepare for the next image formation.

The developing device 4 is mainly constituted by a developing unit 9 and a toner bottle 10 disposed above the unit 9 and playing the role of toner storing means. The developing unit 9 has a casing having an opening which faces the drum 3. A developing sleeve 11 is disposed in the casing to face the drum 1 through the opening and provided with magnets thereinside. A motor, not shown, drives the developing sleeve 11 in a rotary motion. A paddle 12 is located in a bottom portion of the casing to serve as developer agitating means. A permeability sensor, or toner concentration sensor, 13 is also disposed in the casing and affixed to the bottom of the casing. The paddle 12 feeds a developer which is a mixture of toner and carrier to the developing sleeve 11 while agitating it. The permeability sensor 13 senses the concentration of the developer. The toner bottle 10 has a discharge portion at the bottom thereof for supplementing a fresh toner to the developing unit 9. A supplement roller 15 is disposed in the discharge section of the toner bottle 10 and driven by a motor 14 which is in turn driven by a motor driver, not shown. Image density sensing means in the form of an optical sensor 17 adjoins the surface of the drum 3 in a position downstream of the developing unit 9 with respect to the intended direction of rotation of the drum 3. The sensor 17 has a light emitting element for issuing light toward the surface of the drum 3, and a photoelectric transducer on which the resulting reflection from the drum 3 is incident.

The permeability sensor 13 and optical sensor 17 are via connected to a microcomputer respective analog-to-digital (A/D) converters. As shown in the figure, the microcomputer is mainly made up of a microprocessor (CPU) 19, a ROM (Read Only Memory) 20, a RAM (Random Access Memory) 21, and an input/output (I/O) interface 18. The microcomputer delivers a control signal to the motor 14 via the I/O interface 18. A microswitch, not shown, is operated every copying cycle and sends a digital signal to the I/O interface 18. The RAM 21 includes a Vt register, a $Vt_0$ register, a Vs register, a t register, and a copy number register, although not shown specifically. The Vt register temporarily stores a value Vt fed from the permeability sensor 13 via the I/O interface 18. The $Vt_0$ register stores a reference value $Vt_0$ corresponding to a target toner concentration to be set up in the developing unit 9. The Vs register stores a value Vs sent from the optical sensor 17. The t register stores a set period of time t for driving the supplement roller 15 for a single toner supplement. The copy number register is incremented by 1 (one) every time it receives a digital signal from the above-mentioned microswitch, thereby storing the cumulative number of copies produced. The ROM 20 stores a toner concentration control program which will be described.

A procedure for controlling the toner concentration of the developer is as follows. In the illustrative embodiment, the control procedure involves toner supplement control and reference value $Vt_0$ correction. The toner supplement control is such that the output Vt of the permeability sensor 13 which senses a toner concentration in the developing unit 9 every copying cycle is compared with the reference value $Vt_0$ to determine whether or not a supplement is necessary, and if it is necessary, the supplement roller 15 is rotated to supplement the toner. For the reference value $Vt_0$ correction, a toner image for control is formed by the developing unit 4 in a uniformly charged area of the drum 3 (i.e. area charged by the main charger 2, but not illuminated). The output Vs of the optical sensor 17 associated with such a toner image and the output Vt of the permeability sensor 13 are processed to correct the reference value $Vt_0$.

Figure 2:
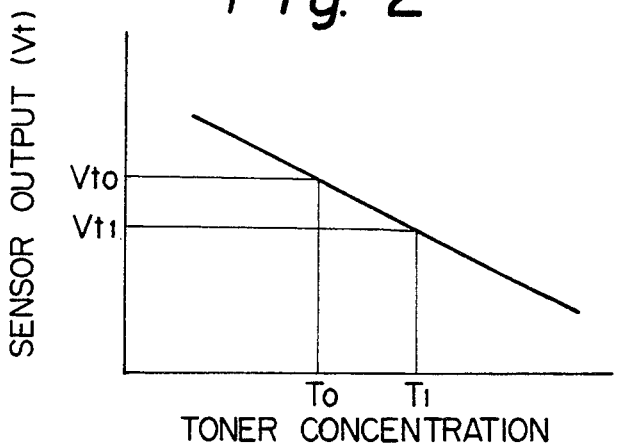
FIG. 2 plots a relation between the toner concentration and the output of a permeability sensor.

To begin with, how the toner supplement control is executed every copying cycle will be described. As shown in FIG. 2, the output Vt of the permeability sensor 13 linearly decreases with the increase in the toner concentration so long as the latter remains in a given range. Using this characteristic, the embodiment rotates the supplement roller 15 to supplement the toner only when the output Vt of the permeability sensor 13 is greater than the reference value $Vt_0$ corresponding to the target concentration. Such toner supplement control is effected every time a copying cycle is effected. Should the toner supplement control be effected during development, the density of the image would change midway. Also, should this kind of control be executed while the paddle 12, for example, was not rotating, the toner would be scattered around due to short charge. Preferably, therefore, the supplement itself should be performed after the trailing edge of the latent image formed on the drum 3 has moved away from the developing sleeve 11 and before the paper is driven out of the copier (in a continuous copy mode, before the leading edge of the next latent image reaches the sleeve 11). Since the amount in which the toner is supplied by a single supplement is proportional to the duration t of the rotation of the supplement roller 15, it is preferable to select the duration t in matching relation to a difference between the output of the permeability sensor 13 and the reference value $Vt_0$.

Figure 3:
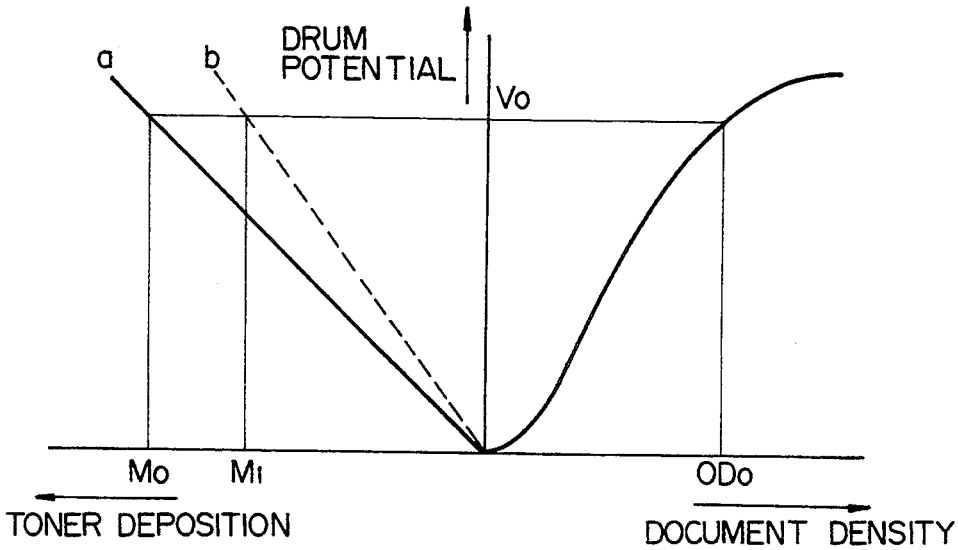
FIG. 3 plots a relation of the density of a document, the potential of a photoconductive element, and the amount of toner deposited on the photoconductive element.

The reference value $Vt_0$ is corrected on the basis of the output of the optical sensor 17, as follows. To better understand the correction, the principle of the correction will be described first. FIG. 3 is a graph indicating the potential of the drum 3 on the ordinate, the density of a document on the abscissa of the first quadrant, and the amount of toner deposited on the drum 3 on the abscissa of the second quadrant. Specifically, the first quadrant indicates a relation between the density of a document and the resulting potential of the drum 3 while the second quadrant indicates a relation between the potential of the drum 3 and the resulting amount of toner deposition on the drum 3 (developing characteristic). In the second quadrant, a and b show respectively a developing characteristic obtainable with a fresh developer and a developing characteristic obtainable with a developer used over a certain period of time and, therefore, effected by aging and changes in environment (although the toner concentration is the same as in the fresh developer). Why the characteristics a and b are different from each other is that generally the characteristic of a developer, particularly the ability of a carrier to charge a toner, changes due to aging and changes in environment, lowering the developing ability of the developer (sometimes the developing ability may increase). Once the developing characteristic changes, a desired image density cannot be achieved even if the toner concentration is constant. For this reason, the embodiment examines the developing characteristic and corrects the reference value $Vt_0$ in such a manner as to set up the desired image density.

Figure 4:
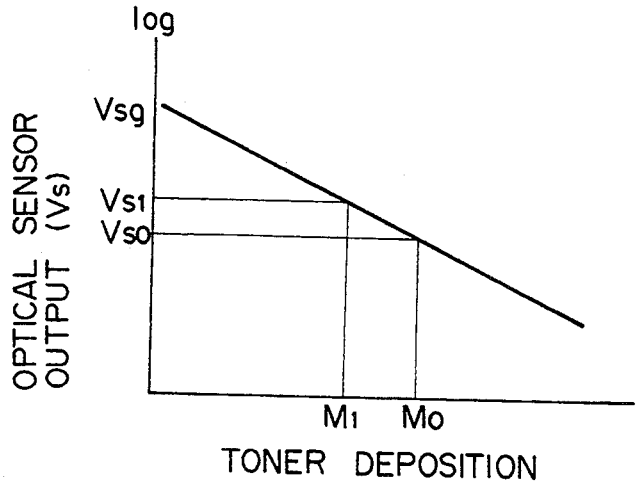
FIG. 4 plots a relation between the amount of toner deposition and the output of a optical sensor.

In FIG. 4, the ordinate and the abscissa indicate respectively the logarithm of the output of the optical sensor 17 and the amount of toner deposition. As FIG. 4 indicates, the relation between the output of the sensor 17 and the amount of toner deposition on the drum 3 can be expressed in terms of exponential. It follows that if the output Vsg of the optical sensor 17 associated with zero toner deposition (i.e. surface of the drum 3 itself) is determined, the output of the sensor 17 associated with the toner deposition can be determined.

Assume that the developing characteristic a shown in the second quadrant of FIG. 3 is the desired characteristic, that such a characteristic a is attained at the initial toner concentration $T_0$, and that toner supplement control is executed by using a toner concentration output $Vt_o$ (see FIG. 2) associated with the toner concentration $T_o$ as the reference value $Vt_o$. In this condition, the toner is deposited in an amount $M_0$ in an area of the drum 3 where the potential is $V_0$, as FIG. 3 indicates, while the output Vs of the optical sensor 17 associated with such an area of the drum 3 is $Vs_0$, as FIG. 4 indicates. The output $Vs_0$ is used as the reference value $Vs_0$ with which the output Vs of the 17 is to be compared. Assuming that the developing characteristic a is degraded to the characteristic b, the amount of toner deposition in the area of the drum 3 where the potential is $V_0$ decreases from $M_0$ to $M_1$. As a result, the corresponding output Vs of the sensor 17 increases from Vs to $Vs_1$ which is greater than the reference value $Vs_0$ (see FIG. 4). This allows the fall of the developing characteristic to be detected by comparing the output Vs of the sensor 17 and the reference value $Vs_0$. Then, the reference value $Vt_0$ may be corrected to, for example, $Vt_1$ (corresponding to $T_1$, FIG. 2) to increase the toner concentration, i.e., developing characteristic. Conversely, if the developing characteristic is excessively high as determined by the sensor 17, the reference value $Vt_0$ will be so corrected as to lower the toner concentration.

It has been customary to correct the reference value $Vt_0$ in response to the output of the optical sensor 17 by simply comparing the instantaneous output Vs of the sensor 17 and the reference value $Vs_0$ and then increase or decrease the instantaneous reference value $Vt_0$ by a predetermined amount. This brings about a drawback that the response falls when the developing characteristic noticeably changes due to, for example, the aging of a photoconductive element and developer, as discussed earlier. To eliminate this drawback, the embodiment corrects the instantaneous reference value $Vt_0$ by taking account not only of the result of comparison of the output Vs of the sensor 17 and reference value $Vs_0$ but also of the associated output Vt of the permeability sensor 13. Specifically, based on the result of comparison of the sensor output Vs and reference value $Vs_0$, the embodiment adds or subtracts a predetermined amount $n \cdot \Delta VT$ to or from the instantaneous output Vt of the permeability sensor 13 and corrects the reference value $Vt_0$ to the resulting value. Here, $\Delta VT$ is a constant while n is a coefficient determined on the basis of a difference between the output Vs of the sensor 17 and the reference value $Vs_0$ and increases with the increase in the difference. The coefficient n and constant $\Delta VT$ are determined beforehand by, for example, experiments. It is to be noted that the correction unit $\Delta VT$ may be the same or different from the case wherein the reference value $Vt_0$ is increased to decrease the toner concentration to the case wherein it is decreased to increase the concentration.

As stated above, in the illustrative embodiment the reference value $Vt_0$ is corrected with consideration given to the output Vt of the permeability sensor 13 appearing at the time of correction. Therefore, even when the developing characteristic noticeably changes after the previous correction of the reference value $Vt_0$, the value $Vt_0$ can be immediately corrected by the next toner supplement control.

Figure 5A:
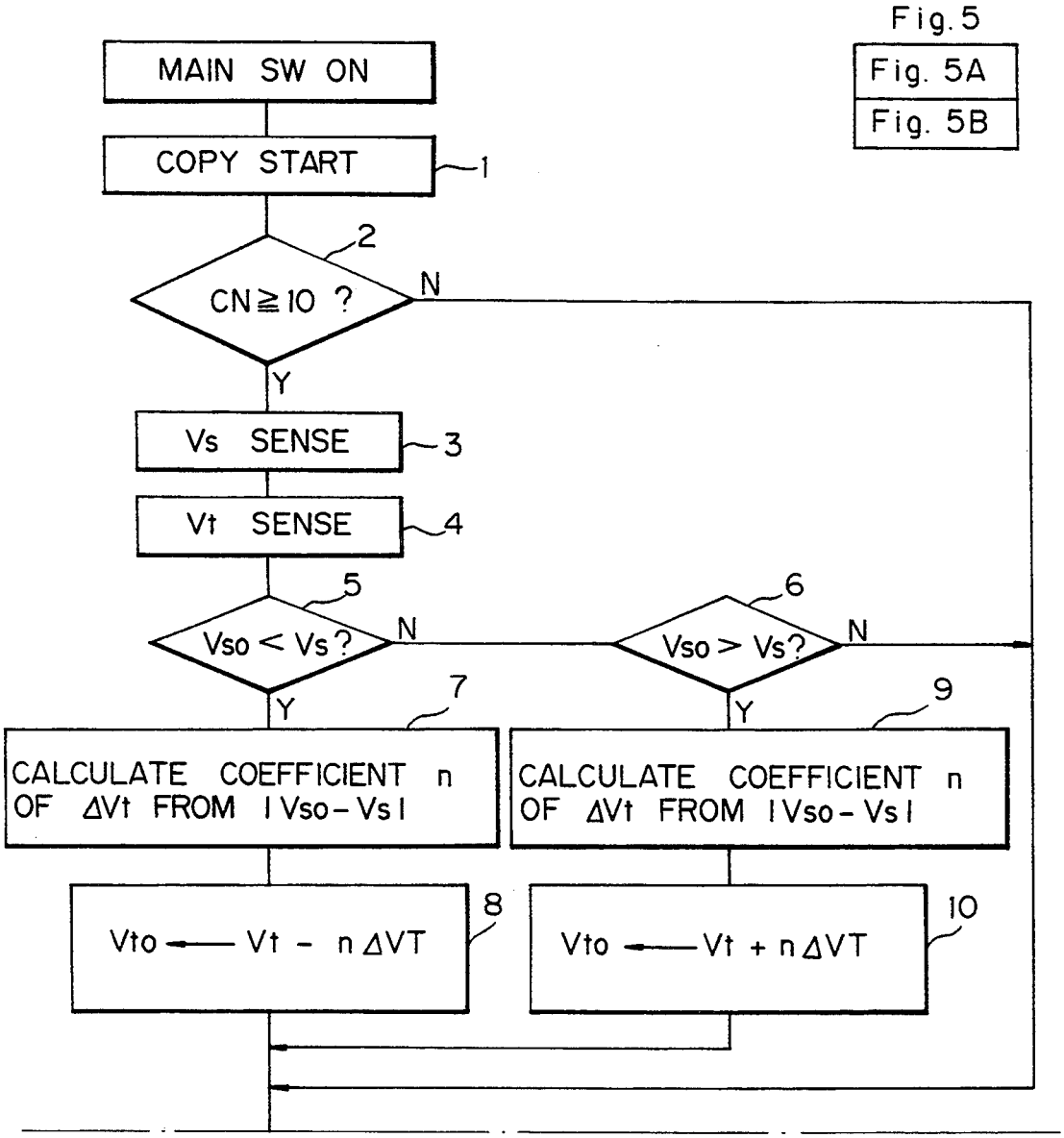
FIG. 5 is a flowchart demonstrating a specific toner concentration control procedure particular to the embodiment.
Figure 5B:
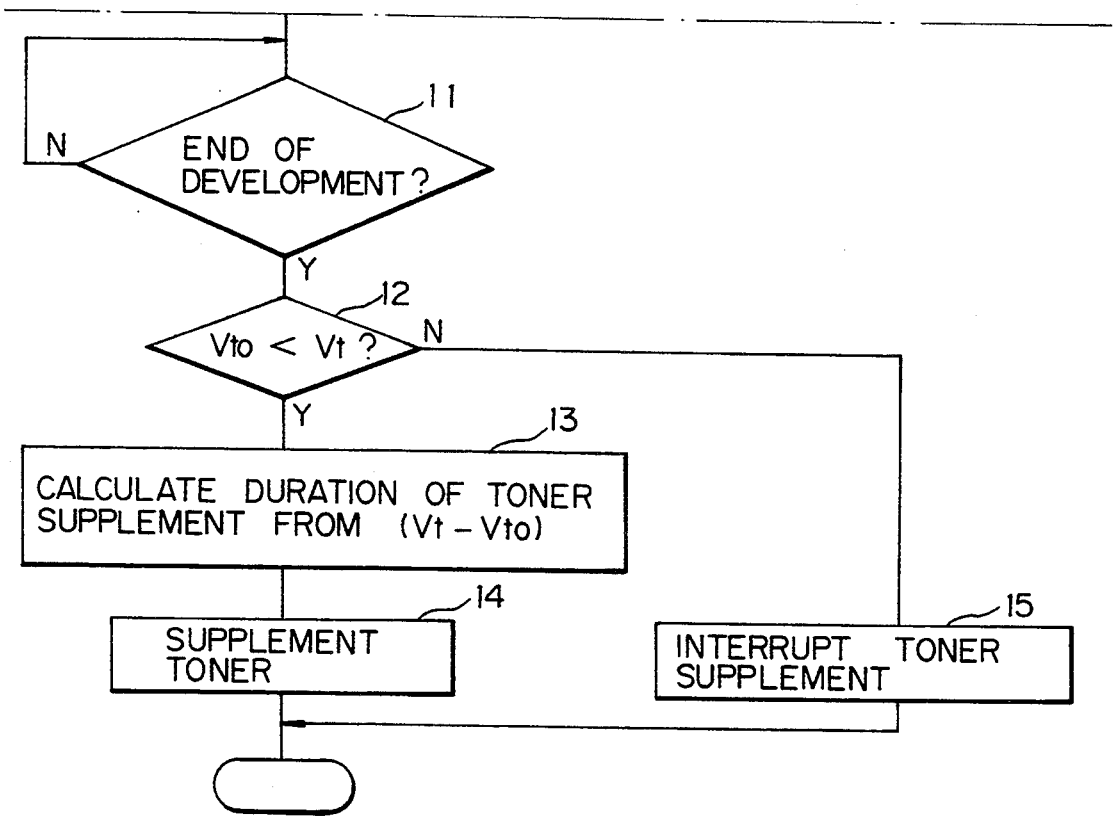

Referring to FIG. 5, a specific toner concentration control procedure particular to the embodiment will be described. As shown, when the main switch of the copier is turned on and then a copying cycle begins (step 1), the cumulative number CN of copies produced in the past is read out of the copy number register to see if it is a multiple of 10 (step 2). Whether or not the time for executing $Vt_0$ correction has been reached is determined on the basis of the result of the step 2. If the answer of the step S2 is negative, N, the program advances to toner supplement control (step 11) which will be described. The reference value $Vt_0$ stored in the $Vt_o$ register is used to effect toner supplement control until the next $Vt_0$ correction.

The toner supplement control begins with a step 11 for waiting until the trailing edge of the latent image moves away from the developing sleeve 11, i.e., the end of development (step 11). On the end of development, the output Vt of the permeability sensor 13 is compared with the reference value $Vt_0$ to see if a toner supplement is necessary (step 12). If the sensor output Vt is greater than the reference value $Vt_0$, meaning that the toner concentration in the developing device 4 is lower than one corresponding to $Vt_0$ (Y, step 12), a period of time for rotating the supplement roller 15 (duration of toner supplement) is calculated (step 13). Then, the supplement roller 15 is rotated for the calculated period of time to supplement the toner (step 14). If the sensor output Vt is smaller than the reference value $Vt_0$ (N, step 12), the supplement roller 15 is held in a halt so as not to supplement the toner (step 15).

As stated above, when the sensor output Vs is greater than the reference value $Vs_0$ and, therefore, $Vt_0$ should be corrected to smaller one, a value produced by subtracting the amount $n \cdot \Delta VT$ from the permeability sensor output Vt of that instant is used as new $Vt_0$. Therefore, when the permeability sensor output Vt is compared with the corrected reference value $Vt_0$ at the time of the immediately preceding toner supplement control, the sensor output Vt will be surely greater than $Vt_0$, indicating that a toner supplement is required. It follows that so long as the output Vs of the optical sensor is determined to be greater than the reference value $Vs_0$, a toner supplement is immediately effected even when the developing characteristic has noticeably changed after the previous $Vt_0$ correction. This is successful in increasing the toner concentration in the developing unit 9, i.e., the amount of toner deposition on the drum 3. Conversely, assume that the sensor output Vs is determined to be smaller than the reference value Vs0, and therefore $Vt_0$ should be increased. Then, the amount $n \cdot \Delta VT$ is added to the permeability sensor output Vt of that instant, and the resulting value is used as new $Vt_0$. Therefore, when the permeability sensor output Vt is compared with the corrected reference value $Vt_0$ at the time of the immediately preceding toner supplement control, the sensor output Vt will be surely smaller than $Vt_0$, indicating that a toner supplement is not required. It follows that so long as the sensor output Vs is determined to be smaller than the reference value $Vs_0$, a copying operation without any toner supplement is performed to lower the toner concentration in the developing unit 9, i.e., the amount of toner deposition even when the developing characteristic has noticeably changed after the previous correction.

Another specific toner concentration control procedure available with the embodiment will be described hereinafter.

The procedure described above corrects the reference value $Vt_0$ by taking account of the instantaneous output Vt of the permeability sensor 13 in addition to the result of comparison of the sensed value Vs and $Vs_0$, so that the response of toner supply control may be enhanced despite a noticeable change in the developing characteristic. By contrast, the procedure which will be described determines, when the sensed output Vs and the reference value $Vs_0$ differs from each other by more than a predetermined amount, whether or not a toner should be supplemented for the subsequent predetermined number iterative copying cycles, e.g., for subsequent five copies on the basis of the result of comparison of Vs and $Vs_0$. Specifically, whether or not the developing characteristic has noticeably changed is determined in terms of whether or not Vs and $Vs_0$ differ from each other by more than a predetermined amount. If the developing characteristic has so changed, whether or not a toner supplement is needed for the subsequent predetermined number of copying cycles is determined on the basis of the result of comparison of Vs and $Vs_0$. Hence, even when the developing characteristic has changed after the previous $Vt_0$ correction, the toner can be supplemented in an amount matching the change in the developing characteristic during the course of the subsequent predetermined number of copying cycles.

Figures 6, 6A, 6B:
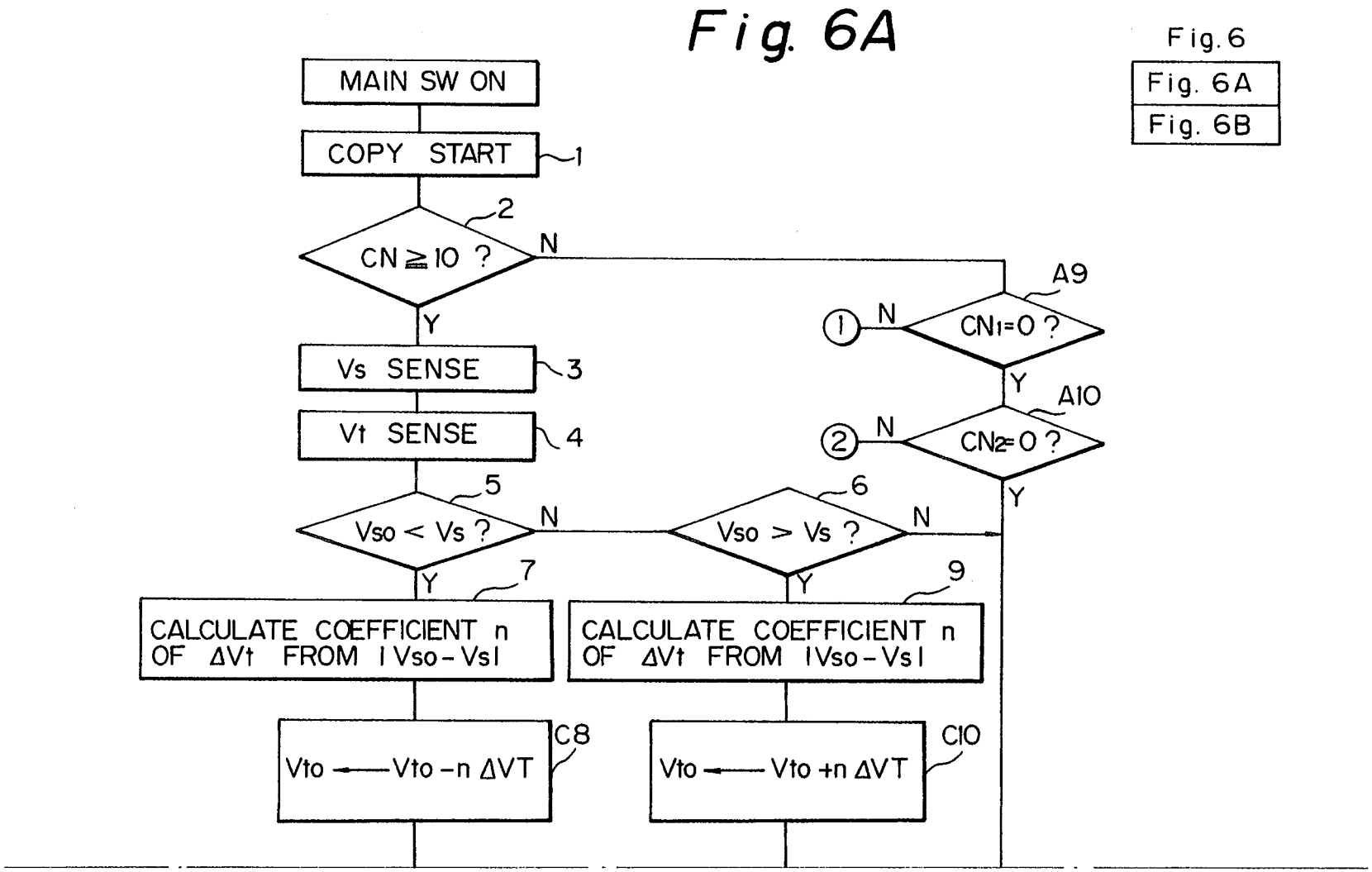
FIG. 6 is a flowchart representative of another specific toner concentration control procedure available with the embodiment.
Figure 6B:
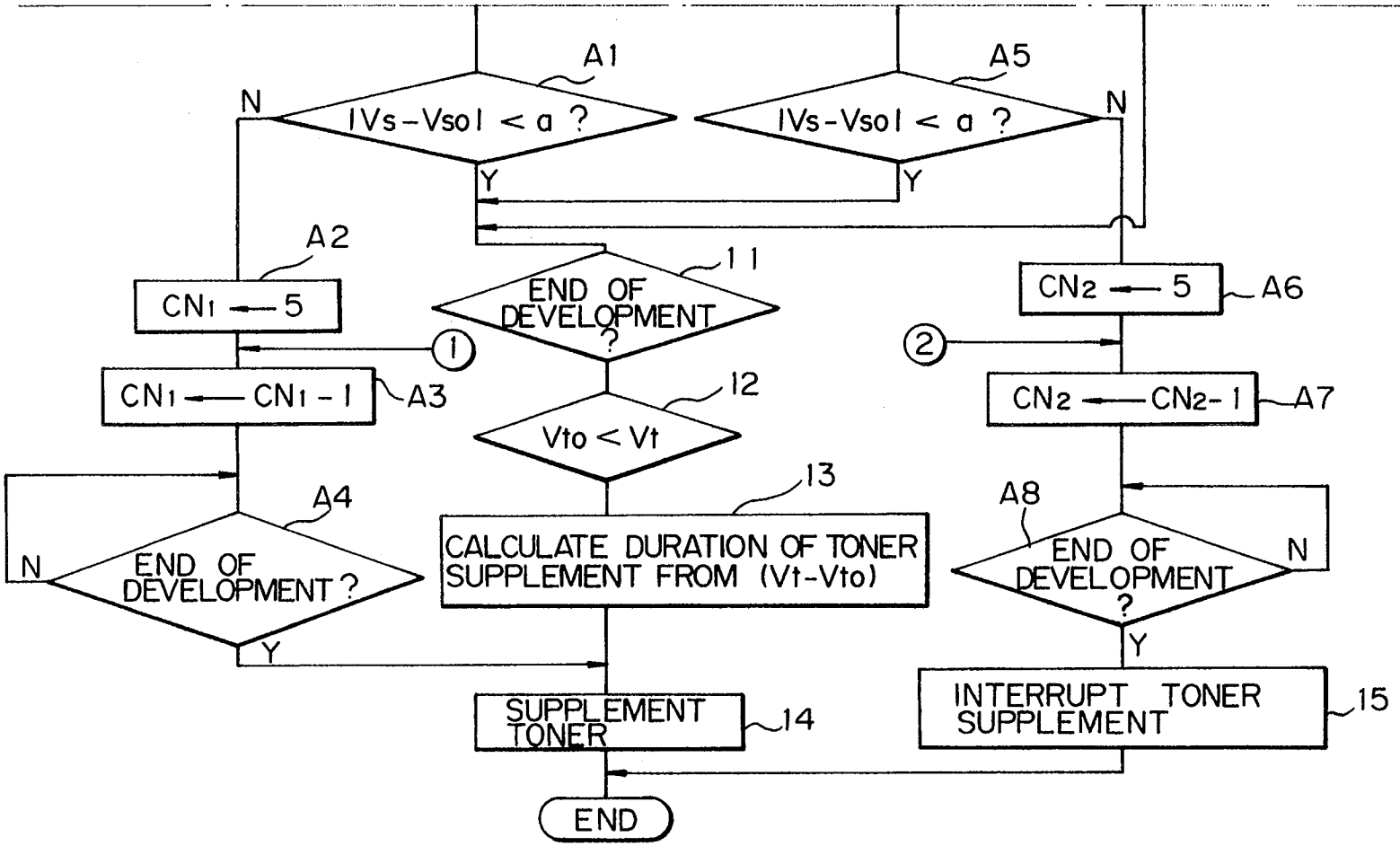

More specifically, as shown in FIG. 6, when the main switch of the copier is turned on and then a copying operation begins (step 1), the cumulative number CN of copies produced in the past is read out of the copy number register to see if it is a multiple of 10 (step 2). Whether or not the time for executing $Vt_o$ correction has been reached is determined on the basis of the result of the step 2. If the answer of the step S2 is positive, the program advances to the correction of the reference value $Vt_0$ (step 3). The $Vt_0$ correction begins with the development of the uniformly charged area and the detection of the amount of toner deposition (step 3), and the detection of toner concentration by the permeability sensor 13 (step 4), as in the previous specific procedure. The resulting output signals are sent to the CPU 19 via the I/O interface 18.

Subsequently, the sensor output Vs and reference value $Vs_0$ are compared (steps 5 and 6), as in the previous procedure. If Vs is greater than $Vs_0$, meaning that the developing characteristic and, therefore, the amount of toner deposition has been lowered (Y, step 5), $Vt_0$ is corrected to smaller one (steps 7 and C8). If Vs is smaller than $Vs_0$, meaning that the developing characteristic and, therefore, the amount of toner deposition has been increased (Y, step 6), $Vs_0$ is controlled to greater one (steps 7 and C10). Further, if Vs is determined to be equal to $Vs_0$ (N, step 6), the program advances to toner supplement control (step 11) without correcting $Vt_0$ of that instant, as in the previously described procedure. Again, $Vt_0$ stored in the $Vt_0$ register is used for toner supply control until the next $Vt_0$ correction. It should be noted that this specific procedure corrects $Vt_0$on the basis of $Vt_0$ of that instant, while the previous procedure uses the permeability sensor output Vt as a reference. Specifically, this procedure adds or subtracts $n \cdot \Delta \cdot VT$ to or from $Vt_0$ of that instant and uses the resulting value as new $Vt_0$ (step C8 or C10).

When $Vt_0$ is corrected or updated, whether or not the developing characteristic .has noticeably changed after the previous $Vt_0$ correction is determined in terms of whether or not the absolute value of the difference between Vs and $Vs_0$ is greater than a predetermined amount a (step A1 or A5). This is contrastive to the previous procedure which immediately advances to toner supplement control (step 11). If the absolute value is greater than the predetermined amount a (N, step A1 or step A5), whether or not to supply the toner is determined on the basis of the result of comparison of Vs and $Vs_0$ only, i.e., without $Vt_0$ and Vt being compared. Specifically, assume that Vs is greater than $Vs_0$ (short toner deposition), and the absolute value of the difference between Vs and $Vs_0$ is greater than a (N, step A1). Then, it is determined that a toner supplement is necessary. At this instant, on the end of development (Y, step A4), the toner is forcibly supplemented with no regard to the permeability sensor output Vt (step 14). This forcible toner supplement may be effected only for a predetermined period of time or for a period of time matching the difference between Vs and $Vs_0$. Conversely, when Vs is smaller than $Vs_0$ (excessive toner deposition) and the absolute value of the difference between Vs and $Vs_0$ is greater than a (N, step A5), it is determined that a toner supplement is not necessary. Then, after the development (Y, step A8), a toner supplement is inhibited with no regard to the permeability sensor output Vt (step 15).

The procedure of FIG. 6 includes a counter CN1 which is initially loaded with 5 and then decremented by 1 (steps A2 and A3) in response to the forcible toner supplement, and a counter CN2 which is also initially loaded with 5 and then decremented by 1 (steps A6 and A7) in response to the forcible interruption of tone supplement. These counters CN1 and CN2 are used to effect respectively the forcible toner supplement and the forcible interruption even during the subsequent four times of copying operation, as will be described later.

If the absolute value of the difference between Vs and $Vs_0$ is smaller than a (Y, step A1 or A5), the program waits for the end of development (step 11), determines whether or not to supplement the toner by comparing $Vt_0$ and Vt (step 12), and supplement the toner, if necessary (steps 13 and 14), as in the previously stated procedure.

If the time for correcting $Vt_0$ has not be reached yet (N, step 2), this procedure does not directly advance to the toner supplement control (step 11). Instead, it executes steps A9 and A10 for determining whether or not the counters CN1 and CN2 are zero, i.e., whether or not the forcible toner supplement or forcible interruption has been determined due to a noticeable change in developing characteristic found by the latest $Vt_0$ correction or, if it has been determined, whether or not four more copies have been produced. If both of the counters CN1 and CN2 are zero (Y, steps A9 and A10), the program directly advances to the toner supply control (step 11). If the counter CN1 is not zero (N, step A9), it is decremented by 1 (step A3), and then the toner supplement is forcibly interrupted (step 15).

As stated above, the procedure shown in FIG. 6 forcibly supplements the toner with no regard to the permeability sensor output Vt (step 14) if Vs is greater than $Vs_0$ (short toner deposition) and the absolute value of the difference between Vs and $Vs_0$ is greater than a (N, step A1). Therefore, even when the amount of toner deposition is short due to a noticeable change in the developing characteristic occurred after the previous $Vs_0$ correction, the toner is immediately supplemented to increase the toner concentration in the developing unit 9 and, therefore, the amount of toner deposition on the drum 3. Conversely, if Vs is smaller than $Vs_0$ (excessive toner deposition) and the absolute value mentioned above is greater than a (N, step 5), the toner supplement is forcibly interrupted with no regard to Vt (step 15). Hence, even when the amount of toner deposition is excessive due to a noticeable change in the developing characteristic after the previous $Vs_0$ control, copying is executed without any toner supplement to reduce the toner concentration in the developing unit 9 and, therefore, the amount of toner deposition.

While the specific procedure of FIG. 6 forcibly effects or interrupts toner supplement with a copy coincident with the time for $Vs_0$ correction and the following four copies, the forcible toner supplement or forcible interruption may be continuously executed with all of the copies until the next $Vs_0$ correction.

The illustrative embodiment directly uses the uniformly charged area of the drum 3 as an image for control. Alternatively, such an area may be trimmed to a desired size by an eraser. If desired, a reference density plate may be located at one edge of the glass platen 1 and illuminated during the course of document scanning to form a corresponding latent image on the drum 3 outside of the document image area, in which case the resulting toner image will be used for the control. Moreover, the amount of toner deposited on such a toner image may alternatively be sensed on a paper, and the sensing means is not limited to the optical sensor 17.

The permeability sensor 13 is a specific form of a toner concentration sensor. When the toner and carrier are different in color from each other, the toner concentration sensor may be implemented as one responsive to the color of the developer.

In summary, it will be seen that the present invention provides a toner concentration control method which, based on the output of a toner concentration sensor and an output representative of the density of a particular image for control, corrects a target toner concentration if the image density is higher or thicker than desired one, so that a toner supplement may be determined to be not necessary by a decision using the corrected target concentration. Therefore, even when the image density is higher or thicker than the desired one due to a change in developing characteristic occurred after the previous correction, image formation is executed without any toner supplement to thereby reduce the toner concentration in a developing device. As a result, the image density is immediately restored to the desired one. Conversely, when the density of the particular toner image is thinner or lower than the desired one, the target toner concentration is corrected such that a toner supplement will be determined to be necessary by a decision using the corrected target concentration. Hence, even when the image density is lower or thinner than the desired one by the above-mentioned cause, the toner is immediately supplied to increase the toner concentration in the developing device.

Further, when the density of the toner image for control is higher or thicker than the desired one by more than a predetermined amount, the method of the invention determines that a toner supplement is not necessary and interrupts the toner supplement during the subsequent predetermined number of copying cycles. Hence, although the image density may become higher or thicker than the desired one due to a great change in developing characteristic after the previous correction, image formation without any toner supplement is executed to reduce the toner concentration in the developing unit, thereby setting up the desired image density immediately. Conversely, when the image density is lower or thinner than the desired one by more than the predetermined amount, the method determines that a toner supplement is necessary and supplements the toner during the course of the subsequent predetermined number of copying cycles. This is also successful in effecting a toner supply immediately to thereby increase the toner concentration in the developing unit.

Various modifications will become possible for those skilled in the art after receiving the teachings of the present disclosure without departing from the scope thereof.

What is claimed is:

1. A toner concentration control method comprising the steps of:

sensing a density of a toner image for control formed on an image carrier by an optical sensor;

sensing a toner concentration of a developer stored in a developing device by a toner concentration sensor mounted on said developing device;

correcting a target toner concentration for toner supplement control on the basis of an output of said toner concentration sensor and an output of said optical sensor;

wherein the step of correcting the target toner concentration further includes determining a correction value based on said output of said optical sensor and a reference density value; and wherein the step of correcting the target toner concentration further includes determining a corrected target toner concentration by one of: (a) adding said correction value to a sensed toner concentration value sensed by said toner concentration sensor; and (b) subtracting said correction value from a sensed toner concentration value sensed by said toner concentration sensor.

2. The method of claim 1, further including controlling an amount of toner supply to said developing device based on a sensed toner concentration value sensed by said toner concentration sensor and the target toner concentration.

3. In a toner concentration control method comprising the steps of sensing a density of a toner image for control formed on an image carrier by an optical sensor, comparing an output of said optical sensor with a reference value corresponding to a desired image density, and correcting, based on a result of comparison, a target toner concentration for toner supplement control to be executed in response to an output of a toner concentration sensor which is mounted on a developing device;

the method further including determining when the output of said optical sensor and said reference value differ from each other by more than a predetermined amount, and in response to a determination that the output of said optical sensor and said reference value differ from each other by more than said predetermined amount controlling whether or not a toner is supplemented during a subsequent predetermined number of copying cycles based on a result of the comparison of the output of said optical sensor and said reference value.

4. The method of claim 3, wherein the step of correcting the target toner concentration further includes determining a correction value based on said output of said optical sensor and said reference value.

5. The method of claim 4, wherein the step of correcting the target toner concentration further includes determining a corrected target toner concentration by one of: (a) adding said correction value to a sensed toner concentration value sensed by said toner concentration sensor; and (b) subtracting said correction value from a sensed toner concentration value sensed by said toner concentration sensor.

6. A toner supply control method comprising:

sensing a toner concentration of a developer stored in a developing device by a toner concentration sensor mounted on said developing device;

controlling supply of additional toner to said developing device based upon a comparison of a sensed toner concentration and a target toner concentration value;

sensing a density of a toner image formed on an image carrier by an optical sensor; and modifying the target toner concentration value based upon both a sensed toner concentration and a sensed toner image density as respectively output by said toner concentration sensor and said optical sensor;

wherein the step of modifying the target toner concentration value includes comparing a sensed toner image density with a reference toner density value and determining a correction value based upon the toner density comparison, and wherein a modified target toner concentration value is based upon one of: (1) a sensed toner concentration plus said correction value; and (2) a sensed toner concentration minus said correction value.

7. A toner supply control method comprising:

sensing a toner concentration of a developer stored in a developing device by a toner concentration sensor stored in said developing device, controlling supply of additional toner to said developing device based upon a comparison of a sensed toner concentration and a target toner concentration value;

sensing a density of a toner image formed on an image carrier by an optical sensor;

determining a difference between a sensed density as sensed by said optical sensor and a reference toner density value;

determining whether said difference is greater than a predetermined difference value; and modifying said target toner concentration value in response to a determination that said difference is greater than said predetermined difference value while maintaining said target toner concentration value in response to a determination that said difference is less than said predetermined difference value.

8. The toner supply control method of claim 7, further including a step of at least temporarily overriding the controlling step based upon said comparison of a sensed toner concentration and a target toner concentration, with said overriding step occurring in response to a determination that said difference is greater than said predetermined difference value.

9. The toner supply control method of claim 8, wherein said overriding step includes suppressing the supply of additional toner when the sensed density of said toner image is greater than said reference toner density value.

10. The toner supply control method of claim 8, wherein said overriding step includes supplying additional toner when the sensed density of said toner is less than said reference toner density value.

11. The toner supply control method of claim 8, wherein said overriding step includes suppressing the supply of additional toner when the sensed density of said toner image is greater than said reference toner density value, and supplying additional toner when the sensed density of said toner is less than said reference toner density value.

12. A developing device including a toner concentration control comprising:

an optical sensor for sensing a density of a toner image formed on an image carrier;

a toner concentration sensor for sensing a toner concentration of a developer stored in said developing device;

control means for correcting a target toner concentration for toner supplement control based on an output of said toner concentration sensor and an output of said optical sensor;

wherein said control means includes means for determining a correction value based on said output of said optical sensor and a reference density value; and wherein said control means determines a corrected target toner concentration by one of: (a) adding said correction value to a sensed toner concentration value sensed by said toner concentration sensor; and (b) subtracting said correction value from a sensed toner concentration value sensed by said toner concentration sensor.

13. The developing device of claim 12, wherein said control means controls an amount of toner supply to said developing device based on a sensed toner concentration value sensed by said toner concentration sensor and the target toner concentration.

14. A developing device including a toner concentration control comprising:

an optical sensor for sensing a density of a toner image formed on an image carrier;

a toner concentration sensor for sensing a toner concentration of a developer stored in said developing device;

means for comparing an output of said optical sensor with a reference value corresponding to a desired image density, and for correcting a target toner concentration for toner supplement control based on the comparison such that said toner supplement control is executed in response to an output of said toner concentration sensor and said target toner concentration; and means for determining when the output of said optical sensor and said reference value differ from each other by more than a predetermined amount and in response to a determination that the output of said optical sensor and said reference value differ from each other by more than a predetermined amount controlling whether or not a toner is supplemented during a subsequent predetermined number of copying cycles based on a result of the comparison of the output of said optical sensor and said reference value.

15. The developing device of claim 14, wherein said control means includes means for determining a correction value based on said output of said optical sensor and said reference value.

16. The developing device of claim 15, wherein said control means determines a corrected target toner concentration by one of: (a) adding said correction value to a sensed toner concentration value sensed by said toner concentration sensor; and (b) subtracting said correction value from a sensed toner concentration value sensed by said toner concentration sensor.

* * * * *